United States Patent [19]

Barnes, Jr.

[11] Patent Number: 4,976,425

[45] Date of Patent: Dec. 11, 1990

[54] EXERCISE APPARATUS FEATURING TORSIONAL TWISTING MOTION IN A STATIONARY EXERCISE DEVICE

[76] Inventor: Gordon B. Barnes, Jr., 6411 Larkmount, Spring, Tex. 77389

[21] Appl. No.: 372,001

[22] Filed: Jun. 22, 1989

[51] Int. Cl.[5] ..... A63B 21/00

[52] U.S. Cl. ..... 272/128; 272/117

[58] Field of Search ..... 272/146, 117, 120, 121, 272/128, 129, 125, 132, 28 R, 28 S, 39, 33 R, 138

[56] References Cited

U.S. PATENT DOCUMENTS

| | | | |
|---|---|---|---|
| 4,305,579 | 12/1981 | Rice | 272/146 |
| 4,313,603 | 2/1982 | Simjian | 272/146 |
| 4,638,996 | 1/1987 | Simjian | 272/146 |
| 4,673,180 | 6/1987 | Rice | 272/128 |
| 4,778,175 | 10/1988 | Wucherpfennig et al. | 272/129 |
| 4,804,178 | 2/1989 | Friedebach | 272/132 |

FOREIGN PATENT DOCUMENTS

| | | | |
|---|---|---|---|
| 2310678 | 9/1974 | Fed. Rep. of Germany | 272/138 |
| 2433347 | 4/1980 | France | 272/128 |

*Primary Examiner*—Richard J. Apley
*Assistant Examiner*—Glenn E. Richman
*Attorney, Agent, or Firm*—Gunn, Lee & Miller

[57] ABSTRACT

An exercise device is set forth. It incorporates an inverted circular cowling which encloses the operative equipment and which centrally supports an upstanding fixed shaft serving as an axis for the rotating equipment. The shaft supports a circular platform for a user. Moreover, the device includes a pair of arms which extend from below the platform radially outwardly on the platform and bend upwardly to position a pair of hand grips for easy grasp by the upright user. The hand grips are rotated reciprocally in repetitive motion. This couples motion to a hub below the platform; the hub is connected through sprockets and drive chains to rotate a fly wheel under the cowling. The fly wheel is rotated first in one direction, then stopped, then rotated in the opposite direction, then stopped and rotated back in the first direction. This repetitive motion is a dynamic exercise routine for strengthening all areas of the body from the continual stopping and starting of the equipment. A stroking motion is applied to the hand grips by the user in an exercise routine.

18 Claims, 1 Drawing Sheet

MOTION INDICATOR
10
12
14
16
18
20
22
24
26
30
32
34
36
38
40
42
44
46
48
50
52
54
56
58
60
62
64
66
68
70
72
74
76
88

EXERCISE APPARATUS FEATURING TORSIONAL TWISTING MOTION IN A STATIONARY EXERCISE DEVICE

BACKGROUND OF THE DISCLOSURE

The present disclosure is directed to an exercise machine in which the user is able to accomplish torsional twisting of the trunk of the body against a variable load so that strengthening is obtained through the repetitive use of the device. More particularly, the present apparatus is a stationary device which has an inverted cover portion adapted to rest on a support surface which encloses the moving components of the present device and which provides a stationary circular platform on which the user may stand. This is particularly an exercise device where the user is permitted to stand upright so that users of various heights can reach down and grasp a pair of opposed handles for applying reciprocating motion to the equipment. The exposed portion of the equipment includes a pair of upstanding divergent movable arms wherein the movable arms are equipped with hand grips at the top end. The hand grips are positioned on telescoping sleeves so they can raise and lower to vary the effective height of each hand grip. Furthermore, the hand grips connect with the arms which extend beneath a circular platform for support of the user and connect with operative equipment which is described in greater detail below.

This device is intended for use in exercising where the user partially rotates his shoulders and especially his arms in first one direction and then the reverse direction. At each reversal, the user must overcome the inertia of a hidden fly wheel which is rotated to absorb energy. As it speeds up, the amount of energy required to overcome the fly wheel is increased. As the user reciprocates faster and faster, greater fly wheel energy is encountered and hence the strength of the user must increase as speed increases.

The device operates in a repetitive fashion. Thus, the user can begin a stroke in one arcuate direction, say clockwise, reciprocate to the full length of the arms of the user, and then overpower the device to rotate in the opposite direction. That stroke is permitted to extend until the arms of the user are again fully extended whereupon another cycle of operation is initiated by the next reversal. The device can be used for several minutes, reversing in rotation every second or so, and thereby provides stretching exercises to the user which generally impact the user and all portions of the users body. Depending upon the vigor and strength of the user, the reversals can be quite vigorous; it is particularly useful for strengthening the trunk of the body and increasing strength which providing flexibility during exercise.

The apparatus of the present structure is particularly safe in operation in the sense that it is driven by the user, and the user can determine the duration and velocity of the device. A low velocity can be selected so that minimal stretching on the user occurs. On the other hand, the peak velocities achieved by the user can be increased so that the strength required is increased when reversal occurs. This is accomplished in a device which has minimal exposed components. It has a base which is a cowling or housing which encloses the moving components. Above the base, there is a fixed platform which permits the user to stand on the top of the device. The only exposed parts which move include a pair of upstanding arms. The arms extend upwardly and diverge slightly so that they are positioned immediately near the sides of the user so that the user can grasp a pair appropriately positioned handles. The handles can be raised or lowered, and thereby permit, person of differing heights to use the device. In that sense, the device is made dynamically adjustable during use. In fact, it is adjustable in all regards in that the user determines the rate of exercise and can make adjustments during operation.

The present apparatus absorbs energy imparted by the exercise of the user, and uses that energy to provide a resistance force overcome by the user in the next stroke of operation. The present device is rotated and then counter rotated, always working against energy stored in a fly wheel. The fly wheel is spun in one direction and then in the other; at the overcoming, the directional change applies a substantial load to the user so that muscle stretch and flexure is required dynamically in contrast with that experienced in dead weight lifting. Accordingly, the exercise is more dynamic, is always changing, and provides a dynamic exercise routine for the user.

Many objects and advantages of the present apparatus will become readily apparent on a consideration of the structure of the present disclosure wherein the present disclosure is and includes a fixed cowling serving as a base supporting a circular fixed platform on which the user can stand. This deployment of equipment provides a relatively streamlined structure. The cowling encloses a fly wheel supported on a shaft, the fly wheel being connected by gears and drive chains. The drive chain and gear transfer system connects with an exposed hub beneath the fixed platform. Diametrically opposed arms are fixed to the hub and extend outwardly radially of the platform and bend upwardly. The two arms support hand grips at the top end, and each arm is made in two parts so that they can telescope.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figures 1, 2:
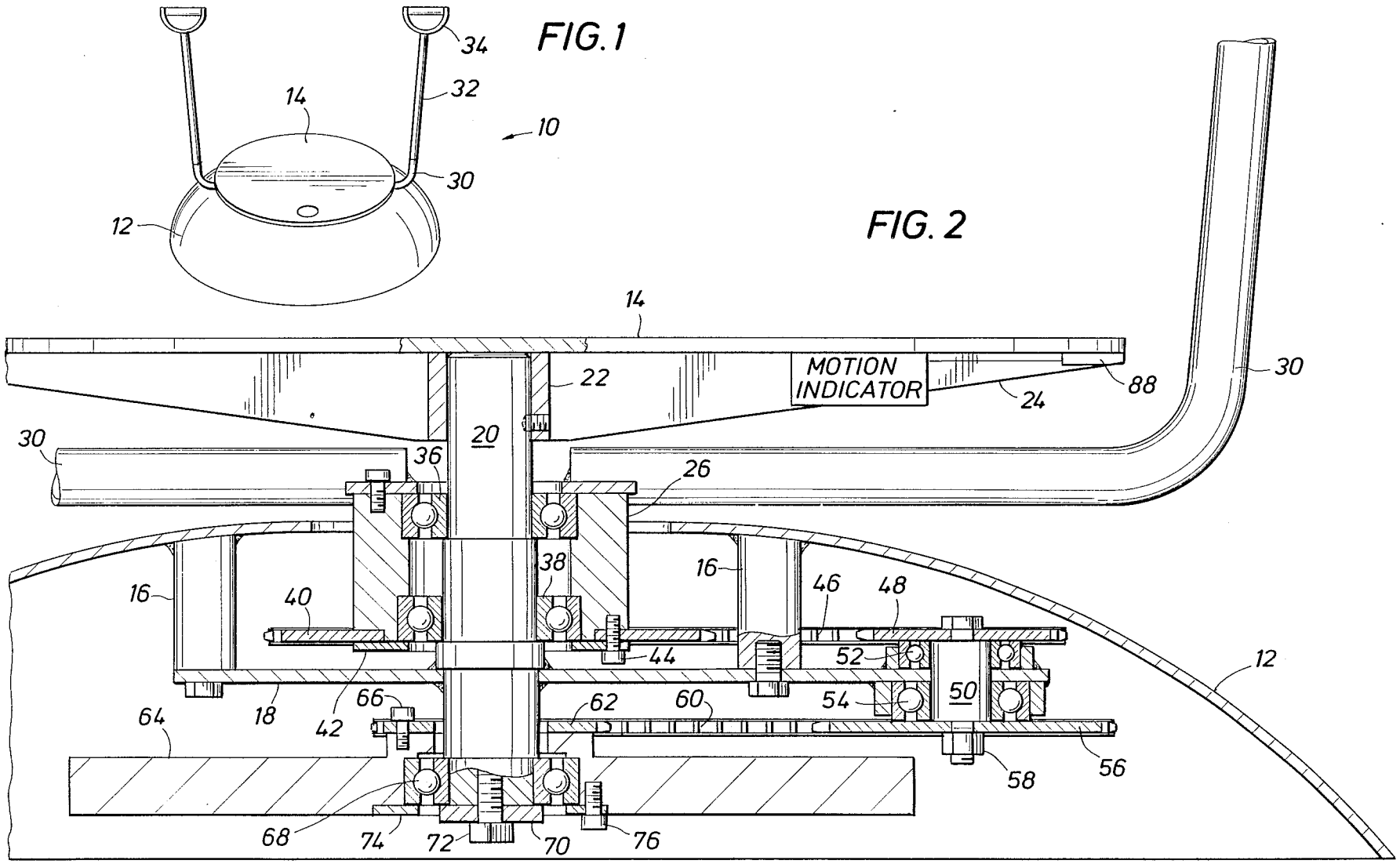
FIG. 1 is a side view of the exercise device of the present disclosure illustrating a floor supported cowling, a fixed circular platform for the user, and upstanding handles with hand grips to be grasped by the user.
FIG. 2 is a detailed sectional view of the exercise device.

Attention is now directed to FIG. 1 of the drawings where the numeral 10 identifies the exercise device of the present disclosure. It incorporates a circular cowling 12 which is just below a platform 14. The cowling is a cover which also supports the weight of the structure on the floor. It covers the operative equipment which will be described in FIG. 2 of the drawings, and moreover, it provides an attractive base beneath and around the circular platform 14. The platform 14 is sized so that a user can comfortably stand on it and upwardly extending arms as will be described are deployed diametrically opposite one another above the cowling 12 and below the platform 14.

Going to FIG. 2 of the drawings, the numeral 12 again identifies the cowling which is arcuate in shape and which has a circular periphery to rest on a support surface. The cowling is hollow to receive the working components. On the interior, the cowling supports a pair of upstanding posts 16 which are welded or otherwise affixed to the cowling. They extend downwardly in parallel fashion and thereby support a transverse mounting plate 18. The plate 18 in turns supports an upstanding central shaft 20. The shaft 20 fastens to the platform 14 at a central hub 22, and the hub is made fast by means of a set screw or the like. There is a space or gap between the platform and the cowling. The platform 14 is provided with radially directed reinforcing ribs 24 to impart strength to it, and the space between the cowling and platform further provides room for an exposed rotatable hub 26. It is centrally around the fixed shaft 20. The shaft 20 serves as a central support or components to be described. The hub 26 is rotatable around the shaft. The hub supports duplicate diametrically extending arms 30 which extend radially outwardly and bend upwardly. The arms are made of hollow tubular stock. As shown in FIG. 1 of the drawings, the arms further include an upper portion which is telescoped. The upper portion 32 thus telescoped over the arm 30, the two portions having coincident straight sections for telescoping purposes. The upper telescoping arm terminates at a hand grip 34 which is sized so that the user can grab it. As shown, there are two such arms and they are diametrically opposite one another extending to the same height. Of course, the height is variable because the arms can be engaged at the hand grip 34 and telescoped as required by the user.

Going back to FIG. 2 of the drawings, the hub 26 is rotatable and provides an anchor or connection for the two arms which are welded or otherwise joined to the hub. The hub is aligned for rotation relatively to the mounting shaft 20, and to this end, first and second bearing assemblies 36 and 38 are also included. These support the rotatable hub.

The hub is constructed to support a sprocket gear 40 at its lower end. The sprocket 40 is provided with teeth of a specified pitch. The sprocket is held in place by a clamp ring 42 which is in turn attached by a fastener 44. The sprocket extends around the lower periphery of the hub 26 to align with and engage a drive chain 46 which engages another sprocket 48.

The sprocket 48 is supported on a shaft 50 and is mounted for rotation. The sprocket is rotatable when driven by the chain 46. The jack shaft 50 is supported by the mounting plate 18. Ideally, the shaft is rotated in an upper bearing 52 and a lower bearing 54. The two bearing assemblies are captured between the upper sprocket 48 and a larger lower sprocket 56. The sprockets are assembled on the shaft 50 by an appropriate nut and bolt fastener 58. The bearing assemblies are arranged on both sides of the mounting plate 18. The two bearing assemblies in conjunction with the upper and lower sprockets thus hold the jack shaft 50 in the illustrated location and align it for power transfer as will be described.

The sprocket 56 engages a link chain 60 which extends around another sprocket 62. The sprocket 62 fits about the shaft 20. The sprocket 62 is fastened to a fly wheel 64 by means of suitable bolts 66, and the fly wheel is supported on the fixed or stationary shaft 20 by a bearing assembly 68. As will be observed, the fly wheel 64 rests on top of the bearing assembly which in turn rests on top of a clamped ring 70 held in place by a bolt 72. In addition, another ring 74 assists in fixing the bearing assembly in place and is anchored by threaded fasteners 76.

Operation of certain components should be next considered. The shaft 20 is fixed and does not rotate. However, it serves as an axis of rotation for other components which are mounted on it. To this end, the bearing assemblies 36, 38 and 68 support components for rotation around the shaft 20. Initial rotation is imparted through the arms to the hub 26. The hub is thus rotated as the arms are rotated. This rotation is imparted through the hub 26 to the sprocket 40 and that movement is coupled through the link chain 46 to the gear system including the four sprocket gears and the two link chains 46 and 60. The relative ratio of this system ought to be considered. It is possible to operate with a ratio of 1:1 so that fly wheel 64 is rotated through an angle equal to that of the hub 26 and the sprocket 40. However, the preferred embodiment utilizes a different ratio. The preferred ratio is approximately 1:2 for the sprockets 40 and 48, and that is again duplicated for the sprockets 56 and 62. This provides an overall system ratio of 1:4, namely one revolution of the hub 26 provides four full revolutions of the fly wheel 64. Indeed, the ratio can be anywhere from 1:1 up to about 1:12. If the ratio is excessive, it makes the handles rather difficult to start in motion, and it is therefore desirable that the ratio be typically in the range of about 1:4 to about 1:9. Obviously, this ratio can be varied for a multitude of reasons.

The weight of the fly wheel 64 and its diameter should be considered. The mass movement of inertia of the fly wheel is dependent on the diameter of the fly wheel and weight thereof. Indeed, the fly wheel can be constructed with spokes and a heavy rim to change the mass moment of inertia. In any case, the fly wheel is an energy storage device in the conventional sense, and in this instance, it is an energy storage device which is rotated to store energy and which is then opposed by the user in the overcoming of the system whereby proper operation permits the user to experience the build up of fly wheel speed as energy is stored and then overcoming of that energy in the counter stroke. Thus, the arms 30 are oscillated through a specified angle; this imparts rotation to the hub 26 ana rotates the fly wheel 64 at a relatively velocity dependent on the drive system ratio.

Consider the present apparatus in operation. In ordinary use of the device, the user will step up on the platform 14 and firmly space their feet on the platform to stand with the hand grips 34 located for easy grasping. The user then grabs the two hand grips, and then starts repetitive oscillatory motion. One grip is pushed forward which the other grip is pushed backwardly. The initial strokes may be relatively short and indeed can move the hand grips through a limited angle of perhaps 20 or 30 degrees of rotation around the platform 14. The stroke can be increased so that the arc of motion is larger, perhaps even 60 to 90 degrees. As this occurs, the hand grips may be raised or lowered with telescoping action as described above. In any case, oscillatory reciprocating motion is applied through the handles 30 to the hub 26.

In FIG. 2 of the drawings, the hub 26 transfers motion from the pair of arms to cause operation of the device. The fly wheel is thus rotated from a stationary position first in one direction, and builds up speed as it rotates. This occurs as energy is absorbed into the fly wheel. As the arms move relative to the user, the user must then extend his own arms and thereafter slow down the equipment and reverse its direction of rotation. At the fly wheel, this involves the build up of energy as it rotates faster and then the braking action is applied as the user retards the fly wheel. The fly wheel is overcome and then is rotated in the opposite direction. This then initiates movement of the arms in the opposite direction. The reciprocating motion applied to the two arms occurs repetitively so that the user can continuously achieve stopping and starting of the fly wheel.

In the perspective of the user, the two handles stay diametrically opposite one another and thus rotate around the the user. The user first drives them with a pushing action and seeks to retard them, accomplishes reversal and thereafter repeats the process. This imparts a reciprocating motion to the apparatus in FIG. 2 which is represented by rotation of the fly wheel, first in one direction, then stopping, and then rotation in the opposition direction.

An important aspect of the present invention is to consider the impact on the user. The user is required to extend arms to the two hand grips 34 which are then moved. At each arm of the user, one hand grip is forced to a position in front of the user; obviously, the other hand moves to a position somewhat to the rear of the user. This provides a stretching action coupled through the arms of the user into the trunk of his body. Some twisting occurs. The extent and vigor of the twisting action is controlled by the user so that proper exercise can be obtained. The exercise pattern involves torso movement, something in the fashion of a twisting motion in comparing the rotation of the knees, hips and shoulders of the user. The torque created in the body of the user is used to operate the device and is therefore a particularly useful therapeutic exercise pattern. One aspect of the therapy involved is that all the muscles in the abdominal region are exercised so that the user is provided with strengthened mid-region muscles which are appropriately stressed and thereby brought to enhanced exercise levels. This is particularly helpful to those who might be weak in the middle or perhaps those who have back difficulties including problems typically associated with back aches and pains. The present device is particularly intended to strengthened the back muscles of a user so that they are less acceptable to back aches and the like.

The exercise pattern of the present device is in large part subject to control of the user. That is, the velocity of the arms is subject to the user and can be increased or decreased as needed. Moreover, the exercise pattern to the user is always dynamic to contrast to weight lifting. This assists in building muscle strength while yet keeping the muscles supple as a result of the stretching exercise achieved by the present device.

Certain scale factors in this device can be modified. For instance, the size and spacing of the arms can be varied. They can be made longer, and can be extended radially further outwardly if desired. The telescoping action can likewise be modified, by raising or lowering the hand grips 34. Scale factors are particularly important in providing a system which is more or less to a certain strength of person. That is, the fly wheel can be made larger in diameter and heavier. Additionally, the ratio of the drive system between the rotated arms 30 and the fly wheel can be changed by changing the gear ratios. The preferred ratios were mentioned above.

FIG. 2 additionally shows an attached proximity or motion sensor which is beneath the platform 14 and which is affixed at a location to detect movement of the metal member 30. That is, the member 30 moves in an oscillatory repetitive pattern. It is detected by the movement or proximity sensor 88 which responds to the metal to form an output signal. Indeed, the output signal indicates the fact that the metal member passes in near proximity and also can indicate the velocity of that movement.

This signal is provided to a motion indicator. That in turn can be located within sight of user, or can be located elsewhere. It serves as an indicator to provide a signal that the equipment is operating. For instance, it can count repetitions such as operation of the device at 20 repetitions per minute, 25 repetitions per minute, etc. It also can provide an indication of instantaneous velocity of the arm as it moves past the detector or sensor 88. This is provided to the output indicating device in the fashion of an odometer or speedometer or both.

The device of the present disclosure can be installed at any conveniently location in left indefinitely. The working components are relatively safe and out of harms way. Periodically, it may be desirable to provide a modes amount of lubrication on the gears and drive chains, and perhaps on the bearing assemblies shown in FIG. 2.

The structure of the present disclosure is relatively straight forward to assemble. Servicing can also be accomplished easily, primarily by removal of the platform 14 which is fastened to the shaft 20 by means of a set screw. Once that is removed, it provides some access to the upper portions of the hub 26. Additional access is obtained by inverting the equipment so that disassembly can occur from the bottom portions of the equipment.

In summary the present disclosure sets forth an exercise device which can be used on a repetitive fashion over a period of time and which has the power absorbing fly wheel and drive system set forth in the present disclosure.

What is claimed is:

1. An exercise device which is used by reciprocating, repetitive strokes wherein the device comprises:

(a) a fixed base having a forward and rearward surface, and having an exposed upper area which permits the user to stand thereon said base having a vertical axis;

(b) a pair of elevated hand grips to enable a user in an upright posture to grasp said hand grips and apply forward and rearward reciprocating motion to said hand grips;

(c) a fly wheel rotatably mounted in said base for rotation about said vertical axis first in one direction and then in the opposite direction wherein fly wheel rotation absorbs energy; and (d) means connecting said hand grips to said fly wheel wherein said connecting means transfers hand grip motion to said fly wheel to impart rotation thereto and the direction of motion is in a first direction and is subsequently reversed to the opposite direction under control by the user.

2. The apparatus of claim 1 wherein said base is a closed housing enclosing said fly wheel, and said hand grips connect to a pair of spaced apart upstanding arms terminating at said hand grips and said hand grips are located to be grasped by the user standing upright on said base.

3. The apparatus of claim 2 wherein said base further includes a top located circular platform permitting the user to stand thereon.

4. The apparatus of claim 3 wherein said hand grips are deployed at the extremities of upstanding/arms and said arms each include tubular portions terminating in telescoping tubular portions connected with said hand grips to thereby permit hand grip elevation independently.

5. The apparatus of claim 1 wherein said fly wheel is supported on a fixed central shaft in said housing and further including:

(a) gear means on said fly wheel; and (b) second gear means wherein said first and second gear means cooperate to impart rotation to said fly wheel at a ratio determined by the relative size of said first gear means and second gear means.

6. The apparatus of claim 1 wherein said base includes:

(a) a central fixed transverse plate therein and said plate supports a laterally located shaft having an upright axis of rotation and said shaft supports first and second gears thereon; and (b) bearing means enabling said gears to transfer rotation imparted by the user through said gears to said fly wheel.

7. The apparatus of claim 6 further including:

(a) means mounting said plate to said base;

(b) means mounting a rotatable hub on said plate;

(c) means mounting a pair of radially extending arms to said hub;

(d) means mounting said hand grips to said arms; and (e) means mounting said fly wheel for support by said plate.

8. The apparatus of claim 7 wherein said base includes:

(a) a surrounding circular cowling around said fly wheel; and (b) foot supporting platform above said cowling.

9. The apparatus of claim 8 including:

(a) a central support shaft within said cowling having an upper end supporting said platform; and (b) further including said central hub mounted thereon for rotation with a bearing assembly.

10. The apparatus of claim 1 wherein said connecting means includes:

(a) first and second gears having a ratio;

(b) third and fourth gears having a second ratio; and (c) said gears connecting serially so that said ratios multiply to define a ratio for rotation of said fly wheel.

11. The apparatus of claim 10 wherein said second and third gears rotate in unison on a common shaft.

12. The apparatus of claim 11 wherein said first and fourth gears rotate on a common shaft at different angular speeds.

13. The apparatus of claim 1 wherein said hand grips are supported on extending arms, and further including means for detecting movement of said hand grips on said arms for forming a motion dependent signal thereof.

14. The apparatus of claim 13 wherein a signal is formed and is provided to an indicator means for forming a visual indication for operation of the exercise device.

15. The apparatus of claim 1 further including means responsive to movement of said hand grips in repetitive fashion so that multiple signals are provided thereof, and said signals are related to the number of operations of present apparatus.

16. An exercise device which is used by reciprocating, repetitive strokes wherein the device comprises:

(a) a fixed base having a forward and rearward surface, and having an exposed upper area which permits the user to stand thereon said base having a vertical axis;

(b) a pair of spaced user engaged means to enable a user during exercise to engage said means and apply forward and rearward reciprocating motion to said engaged means;

(c) a fly wheel rotatably mounted in said base for rotation about said vertical axis first in one direction and then in the opposite direction wherein fly wheel rotation absorbs energy; and (d) means connecting said user engaged means to said fly wheel wherein said connecting means transfers user engaged means motion to said fly wheel to impart rotation thereto and the direction of motion is in a first direction and is subsequently reversed to the opposite direction under control by the user.

17. The apparatus of claim 16 wherein said base is a closed housing enclosing said fly wheel, and said user engaged means, connect to a pair of spaced apart upstanding arms terminating at said user engaged means are located for engagement by the user on said base.

18. The apparatus of claim 17 wherein said base further includes a top located circular platform permitting the user to stand thereon.

* * * * *